US008215208B2

(12) United States Patent
Blackston et al.

(10) Patent No.: US 8,215,208 B2
(45) Date of Patent: Jul. 10, 2012

(54) TOOL HOLDER WITH PIVOTING BIT

(75) Inventors: Mike Blackston, Plymouth, MN (US); Mark Petroske, Becker, MN (US)

(73) Assignee: Bondhus Corporation, Monticello, MN (US)

( * ) Notice: Subject to any disclaimer, the term of this patent is extended or adjusted under 35 U.S.C. 154(b) by 338 days.

(21) Appl. No.: 12/760,845

(22) Filed: Apr. 15, 2010

(65) Prior Publication Data

US 2011/0252928 A1 Oct. 20, 2011

(51) Int. Cl.
*B25B 23/00* (2006.01)
*B25B 15/00* (2006.01)

(52) U.S. Cl. ..... 81/177.75; 81/440

(58) Field of Classification Search ..... 81/440, 81/177.7, 177.75, 460
See application file for complete search history.

(56) References Cited

U.S. PATENT DOCUMENTS

| | | | | |
|---|---|---|---|---|
| 2,667,194 | A | 6/1954 | Fisher et al. | |
| 2,773,529 | A | 12/1956 | Valenti | |
| 4,271,731 | A | 6/1981 | Suligoy et al. | |
| 4,436,005 | A * | 3/1984 | Hanson | 81/177.75 |
| 4,711,145 | A | 12/1987 | Inoue | |
| 5,042,332 | A | 8/1991 | Nickipuck | |
| 5,251,521 | A | 10/1993 | Burda et al. | |
| 5,370,021 | A * | 12/1994 | Shigematsu | 81/436 |
| 5,408,905 | A | 4/1995 | Mikic et al. | |
| 5,577,426 | A | 11/1996 | Eggert et al. | |
| 5,738,586 | A * | 4/1998 | Arriaga | 464/106 |
| 6,347,564 | B1 | 2/2002 | Ciocca | |
| 6,575,062 | B2 * | 6/2003 | Hahn | 81/460 |
| 6,684,741 | B2 | 2/2004 | Blackston | |
| 6,729,211 | B1 * | 5/2004 | Snow | 81/177.75 |
| 7,278,342 | B1 | 10/2007 | Chang | |
| 2005/0235785 | A1 | 10/2005 | Chang | |
| 2008/0168868 | A1 * | 7/2008 | Yang | 81/177.75 |
| 2011/0017029 | A1 * | 1/2011 | Chen | 81/177.75 |

FOREIGN PATENT DOCUMENTS

GB 2445737 A 7/2008

OTHER PUBLICATIONS

International Search Report and Written Opinion for PCT/US2010/031601, dated Dec. 8, 2010.

* cited by examiner

*Primary Examiner* — David B Thomas
(74) *Attorney, Agent, or Firm* — Stoel Rives LLP

(57) ABSTRACT

A bit holder and an interchangeable bit that can pivot or articulate relative to the bit holder. The bit holder includes a multi-depth socket for receiving the interchangeable bit. The different depths of the socket determine whether the interchangeable bit operates as a straight-on bit or an off-angle bit. An outer sleeve can slide along a longitudinal axis of a shaft to change the depth of the socket. Alternatively, opposite ends of the bit holder have different depth sockets for receiving the interchangeable bit and/or a shank portion. By flipping over the bit holder, the interchangeable bit can operate as either a straight-on bit or an off-angle bit.

17 Claims, 6 Drawing Sheets

TOOL HOLDER WITH PIVOTING BIT

FIELD OF THE DISCLOSURE

The present disclosure is directed to a bit holder and an interchangeable bit that can pivot or articulate relative to a longitudinal axis of the bit holder, and in particular, to a bit holder with a multi-depth socket for receiving the interchangeable bit in either a locked configuration or one or more unlocked configurations.

BACKGROUND OF THE INVENTION

Typical magnetic bit holders include a cylindrical body having a socket formed axially in one end configured to receive one of a plurality of interchangeable bits. The socket of the bit holder typically has a transverse cross-sectional shape which is non-circular, such as polygonal. The proximal end of the bit has a complementary shape that fits in the socket. A permanent magnet is typically press-fitted or crimped into a hole at the base of the socket to magnetically retain the associated bit in place.

For many applications, however, the location of fasteners prevents the user from directly aligning the bit holder with the fastener. This limitation impedes the ability of the user to apply maximum torque to the fastener, and increases wear on both the fastener and the interchangeable bit. In order to overcome this problem, hand tools have been designed that have working ends displaceable or pivotable away from the longitudinal axis of the shank of the tool.

U.S. Pat. No. 2,773,529 (Valenti) discloses a screwdriver having a pivotable tool bit part which allows it to be pivoted to a right angle to the screwdriver shank by the rotation of a clamp member which manually holds the tool bit part in alignment with the shank.

U.S. Pat. No. 4,271,731 (Suligoy et al.) discloses a socket member pivotally attached to a shaft by means of pivot pins. The socket member includes a socket cavity having a conventional polygonal or ribbed cross-section to receive the correspondingly cross-sectioned shank end of a bit. In one embodiment, an elongated collar is provided to retain the socket member in axial alignment with the shaft.

U.S. Pat. Nos. 4,711,145 (Inoue); 5,042,332 (Nickipuck); and 5,577,426 (Eggert et al.) each teach fastener-driver constructions having an angularly-displaceable component.

These embodiments, however, locate the pivot point of the bit relative to the bit holder too far behind the working end of the bit. The misalignment requires eccentric rotation of the bit, resulting in excessive wear on both the working end of the bit and the fastener.

U.S. Pat. No. 2,667,194 (Fisher et al.) discloses interchangeable bits that are retained in the bit holder by a snap ring. The square bit receiving socket has a somewhat larger cross section than the square portion of the bit. The resulting clearance permits the bit to "float" in the socket so that the components may be out of axial alignment and still provide proper driving of the bit and proper fit of the bit point with the screw. Fisher discloses clearances in the range of about 0.005 inches to about 0.010 inches, corresponding to an angular displacement of the bit in the socket of less than about 3 degrees. Large axial forces along the longitudinal axis of the bit and the bit holder drive the flat end of the bit into the base of the receiving socket, inhibiting angular displacement.

BRIEF SUMMARY OF THE INVENTION

The present disclosure relates to a bit holder and an interchangeable bit that can pivot or articulate relative to the bit holder. The bit holder includes a multi-depth socket for receiving the interchangeable bit. The different depths of the socket determine whether the interchangeable bit operates as a straight-on bit (i.e., locked configuration) or an off-angle bit (i.e., unlocked configuration).

In one embodiment, an outer sleeve slides along a longitudinal axis of a shaft to change the depth of the socket. In another embodiment, the opposite ends of the bit holder have different depth sockets for receiving the interchangeable bit and/or a shank portion. The deeper socket provides the locked configuration and the shallower socket provides the unlocked configuration. By flipping over the bit holder, the interchangeable bit can operate as either a straight-on bit or an off-angle bit.

In one embodiment, the bit holder includes a shaft with a proximal end adapted to couple with a driver. The distal end of the shaft magnetically couples to an interchangeable bit. An outer sleeve surrounds the shaft in an unlocked configuration to form a socket with a non-circular cross section near the distal end of the shaft. The interchangeable bit includes a working end and a proximal portion with a non-circular cross section complementary to the socket. The proximal portion including a plurality of contoured portions that permit the interchangeable bit to articulate in the socket. The interchangeable bit further includes a relief located between the working end and the proximal portion configured to engage with distal end of the outer sleeve that limits articulation of the interchangeable bit relative to the shaft. The outer sleeve includes a locked configuration such that the distal end of the outer sleeve engages with a body portion of the interchangeable bit to retain the interchangeable bit in general alignment with a longitudinal axis of the shaft.

The bit holder preferably includes a magnet located near the distal end of the shaft. Alternatively, the interchangeable bit can be magnetic. The bit can also be mechanically coupled to the bit holder.

The bit holder preferably includes a locking mechanism adapted to retain the outer sleeve in either the unlocked configuration or the locked configuration. In one embodiment, the locking mechanism includes a snap ring interposed between the outer sleeve and the shaft, a first set of grooves on the shaft adapted to engage with the snap ring when the outer sleeve is in the unlocked configuration, and a second set of groove on the shaft adapted to engage with the snap ring when the outer sleeve is in the locked configuration.

In one embodiment, a flat portion is located on the proximal portion of the interchangeable bit and a corresponding flat portion is provided on the distal end of the shaft. The two flat portions cooperate to retain the interchangeable bit generally aligned with a longitudinal axis of the shaft even when the outer sleeve is in the unlocked configuration.

The contoured portions on the interchangeable bit are optionally a plurality of facets or a curvilinear configuration. In one embodiment, the proximal portion on the interchangeable bit includes a hexagonal cross section and the socket includes a plurality of surfaces arranged in a complementary hexagonal configuration. The interchangeable bit articulates primarily in a plane perpendicular to one of the plurality of surfaces.

The maximum angle of articulation of the interchangeable bit relative to the longitudinal axis can be controlled by the depth of the relief and/or the location of the outer sleeve along the shaft. The maximum angle of articulation for the interchangeable bit is preferably between about 5 degrees to about 25 degrees. The minimum angle of articulation is about 5 degrees.

A pivot location for the articulation preferably extends through the interchangeable bit perpendicular to the longitudinal axis. The pivot location is preferably less than about 1.0 inch, or less than about 0.4 inches, from a distal-most portion of the working end.

In another embodiment, the bit holder includes an outer sleeve secured to a shaft to form a first socket with a first depth, and a second socket with a second depth greater than the first depth, at opposite ends of the outer sleeve. The first and second sockets each include a non-circular cross section. A shank portion is provided with a non-circular cross section complementary to the first and second sockets. At least one interchangeable bit includes a working end and a proximal portion with a non-circular cross section complementary to the first and second sockets. The proximal portion including a plurality of contoured portions that permit the interchangeable bit to articulate in the first socket. The interchangeable bit further including a relief located between the working end and the proximal portion configured to engage with distal end of the outer sleeve to limit articulation relative to the intermediate shaft. By contrast, when the interchangeable bit is engaged with the second socket, the outer sleeve engages a body portion of the interchangeable bit to retain the interchangeable bit generally aligned with a longitudinal axis of the shaft.

DETAILED DESCRIPTION OF THE INVENTION

Figure 1:
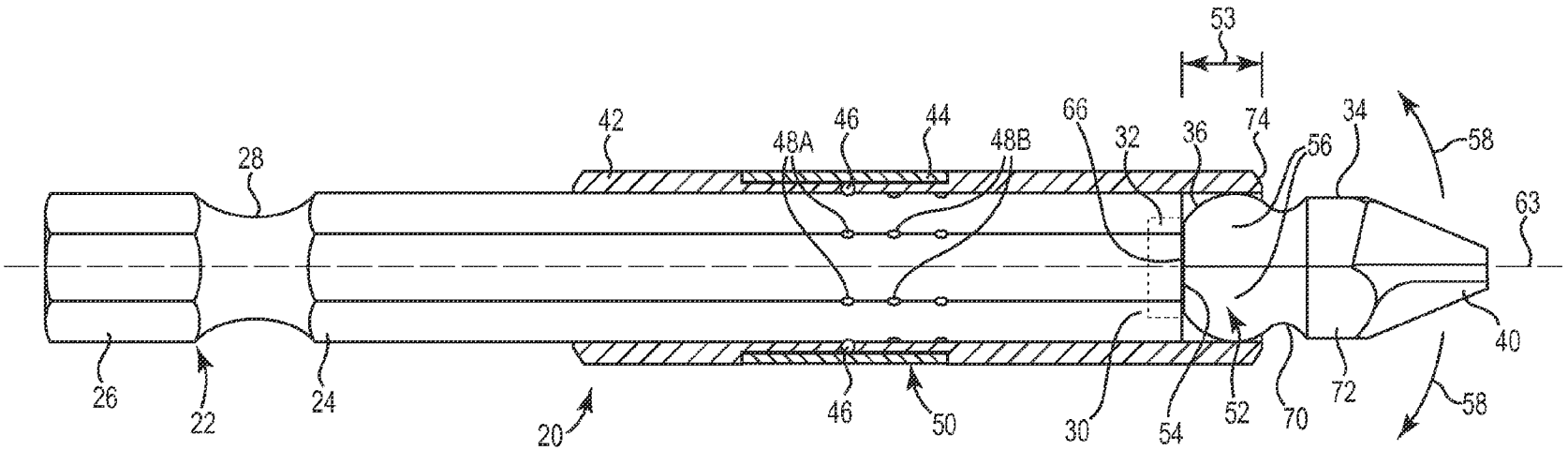
FIG. 1 is a side sectional view of a bit holder and an interchangeable bit in accordance with an embodiment of the present disclosure.

FIG. 1 is a side sectional view of bit holder 20 in accordance with an embodiment of the present disclosure. Proximal end 22 of shaft 24 includes shank 26 and groove 28 adapted to coupled to a driver, such as an electric drill or a tool handle. Distal end 30 of the shaft 24 preferably includes magnet 32 adapted to magnetically retain interchangeable bit 34 in socket 36. In an alternate embodiment, the interchangeable bit 34 can be magnetized.

Socket 36 is formed by outer sleeve 42 surrounding the shaft 24. The depth 53 of the socket 36 is determined by the location of the outer sleeve 42 relative to the shaft 24. Proximal portion 52 of the interchangeable bit 34 includes contoured portions 56 that permit articulation in the socket 36 in directions 58. Relief 70 located between the proximate portion 52 and body portion 72 on the interchangeable bit 34 engages with distal end 74 of outer sleeve 42 to limit articulation.

In the embodiment of FIG. 1, the outer sleeve 42 includes compression member 44 that biases snap ring 46 into grooves 48A in the shaft 24. The compression member 44 and snap ring 46 retain the outer sleeve 42 in unlocked configuration 50 along longitudinal axis 63 of the shaft 24.

Modifying the depth of the relief 70 or the depth 53 of the socket 36 will alter articulation 58 of the interchangeable bit 34. The locations of the grooves 48A illustrated in FIG. 1 can be adjusted to move the outer sleeve 42 as desired. In another embodiment, the shaft 24 includes additional sets of grooves 48B to permit the socket 36 to be adjusted to multiple depths 53.

Figure 5:
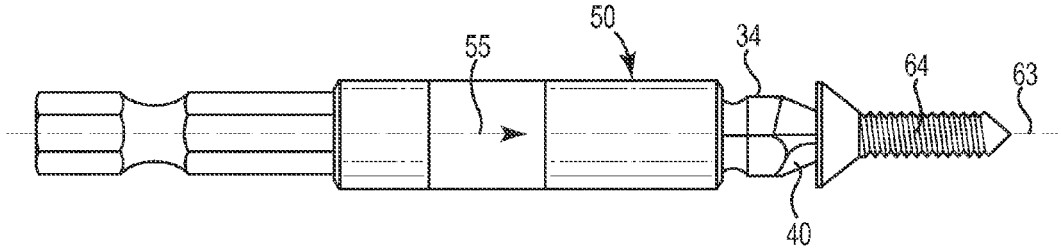
FIG. 5 is a side view of the bit of FIG. 1 engaged with a fastener in accordance with an embodiment of the present disclosure.

The proximal portion 52 of the interchangeable bit 34 optionally includes a flat end 54 that couples with the magnet 32. The flat end 54 on the proximal portion 52 aids in retaining the interchangeable bit 34 in axial alignment with longitudinal axis 63. Compressive forces 55 along the longitudinal axis 63 (such as illustrated in FIG. 5, generated when the working end 40 is engaged with a fastener 64) serve to stabilize the flat end 54 against bottom 66 of the socket 36, even if the outer sleeve 42 is in the unlocked configuration 50.

In the illustrated embodiment, working end 40 of the interchangeable bit 34 is a Phillips screw driver. Alternatively, the working end 40 can be ballpoint tools, Torx drivers, square drivers, hex wrenches, star drivers, socket wrenches, flat-head screw drivers, or a variety of other configurations.

Figure 2:
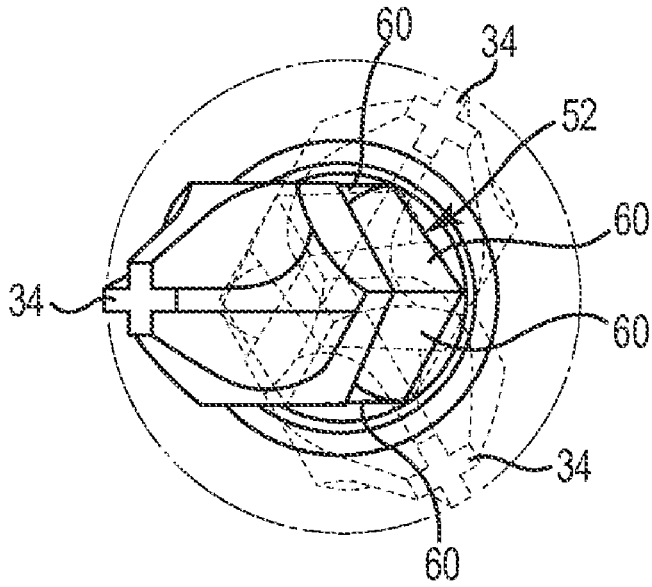
FIG. 2 is an end view illustrating articulation of the bit relative to the bit holder of FIG. 1 in accordance with an embodiment of the present disclosure.
Figure 3:
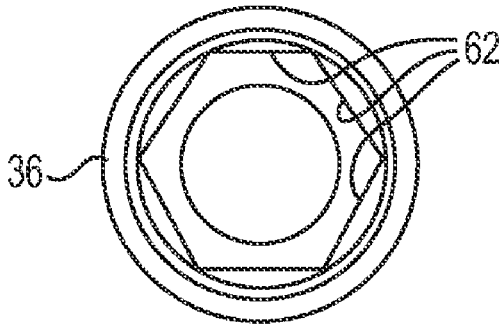
FIG. 3 is an end view of a socket in the bit holder of FIG. 1 with the bit removed.

As best illustrated in FIGS. 2 and 3, proximal portion 52 of the interchangeable bit 34 has a generally hexagonal cross section with six discrete surfaces 60 that are complementary to interior surfaces 62 of socket 36 arranged in a hexagonal configuration. Articulation of the interchangeable bit 34 is typically perpendicular to one of the surfaces 62 of the socket 36. In alternate embodiments, the socket 36 and proximal portions 52 can have other non-circular cross-sectional shapes, including triangular, square, pentagonal, star-shaped, curvilinear, and the like.

Figure 4A:
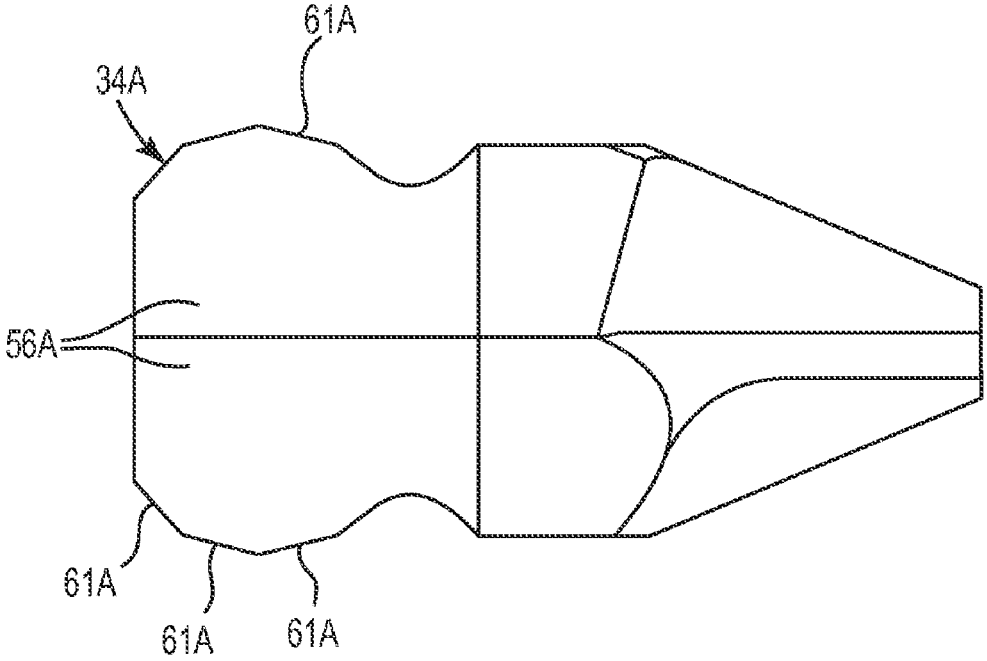
FIG. 4A is a side view of an alternate interchangeable bit in accordance with an embodiment of the present disclosure.
Figure 4B:
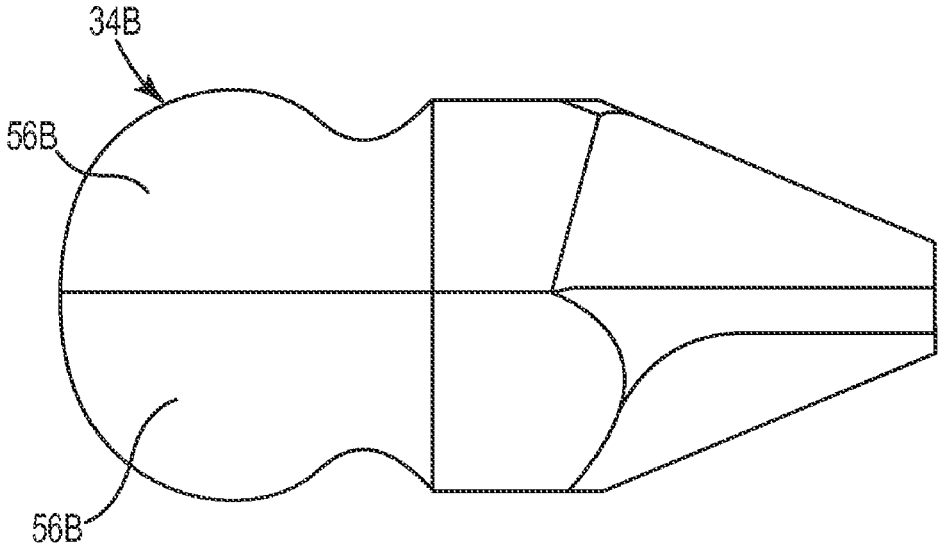
FIG. 4B is a side view of another alternate interchangeable bit in accordance with an embodiment of the present disclosure.

FIG. 4A illustrates an alternate interchangeable bit 34A where contoured portions 56A includes a plurality of facets 61A that approximate a curvilinear shape. FIG. 4B illustrates another alternate interchangeable bit 34B in which the contoured portions 56B are curvilinear, without the flat portion. The radius of curvature of the contoured portions 56B can be uniform or non-uniform. The contoured portions 56B can have a variety of other shapes, such as for example, circular or elliptical. In one embodiment, the contoured portions 56B correspond generally to the shape of a Torx driver, such as illustrated in U.S. Pat. Nos. 5,251,521 (Burda et al.) and 5,408,905 (Mikic et al), both of which are incorporated by reference.

Figure 6:
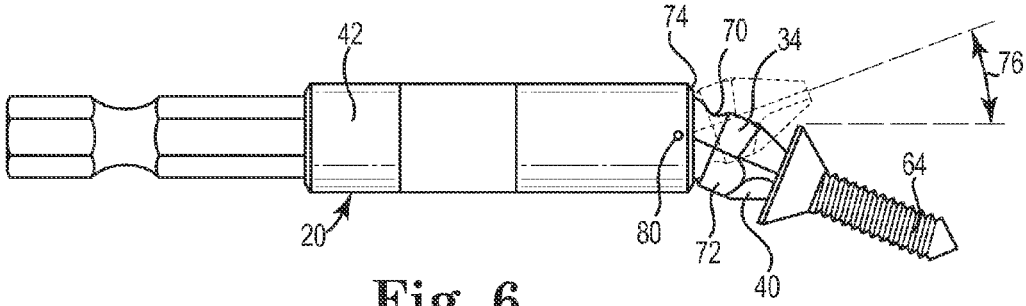
FIG. 6 is a side view of the bit of FIG. 1 angled with respect to the bit holder in accordance with an embodiment of the present disclosure.

FIG. 6 illustrates angle of articulation 76 of the interchangeable bit 34 relative to the bit holder 20. The angle of articulation 76 is preferably between about 5 degrees to about 25 degrees. The angle of articulation 76 can be adjusted by a variety of mechanisms.

The configuration of the present interchangeable bit 34 results in a pivot location 80 extremely close to the working end 40. The pivot location 80 is located within the proximal portion 52 of the interchangeable bit 34. In embodiments where the contoured portions 56 are circular, the pivot location 80 may be a point. Where the contoured portions 56 are not circular, the pivot location 80 may be a sphere, an elliptical volume, or a variety of other shapes.

In the preferred embodiment, the pivot location 80 is less than about 1.0 inches from the distal-most portion of the working end 40. In another embodiment, the pivot location 80 is less than about 0.4 inches from the distal-most portion of the working end 40. Consequently, wear on the working end 40 and vibration while driving fastener 64 are minimized.

Figure 8:
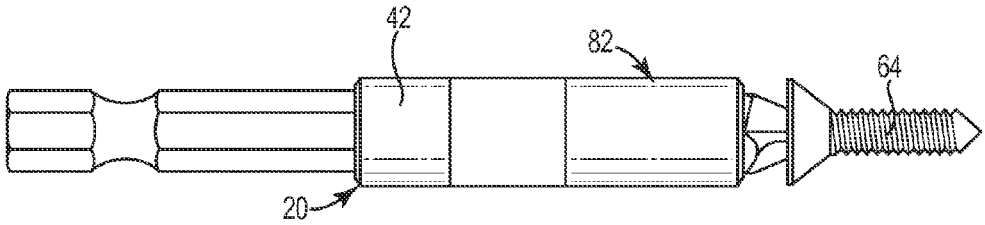
FIG. 8 is a side view of an outer sleeve retaining the bit of FIG. 1 in axial alignment with the bit holder in accordance with an embodiment of the present disclosure.
Figure 7:
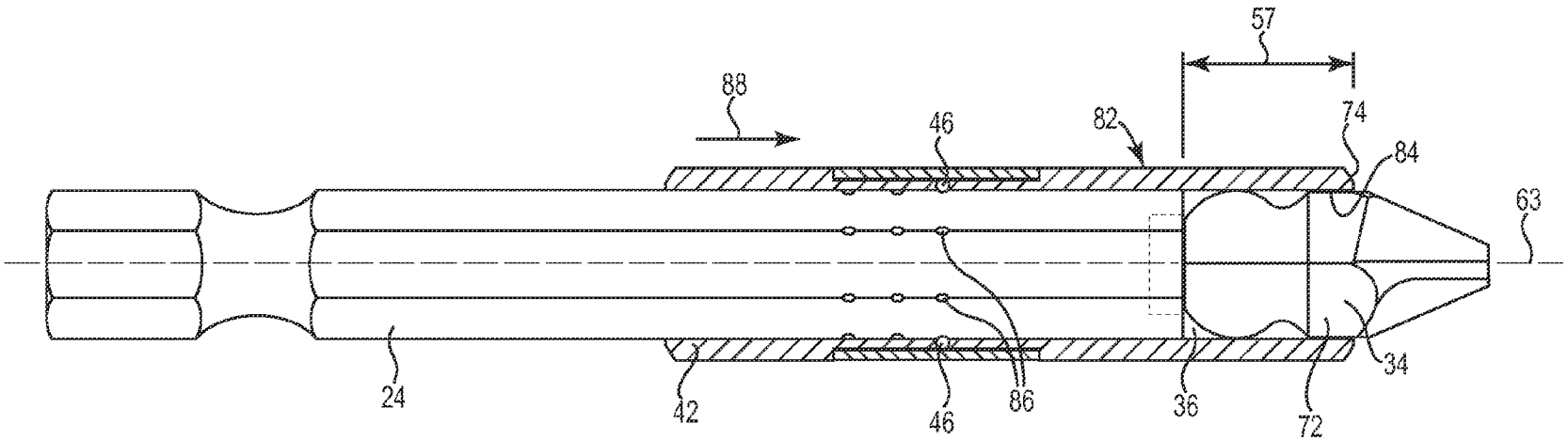
FIG. 7 is a sectional view of the bit holder of FIG. 1 with the outer sleeve retaining the bit in axial alignment in accordance with an embodiment of the present disclosure.

FIG. 7 is a side sectional view of the bit holder of FIG. 1 with the outer sleeve 42 slid forward in direction 88 to locked configuration 82 in accordance with an embodiment of the present disclosure. In the embodiment of FIG. 7, the socket 36 has a second depth 57, greater than the depth 53 illustrated in FIG. 1. In the locked configuration 82, inner surface 84 of the sleeve 42 near the distal end 74 engages with body portion 72 to retain the interchangeable bit 34 in axial alignment with longitudinal axis 63. Snap ring 46 engages with forward grooves 86 formed in the shaft 24 to retain the outer sleeve 42 in the locked configuration 82. FIG. 8 illustrates the bit holder 20 driving fastener 64 with the outer sleeve 42 in the locked configuration 82.

Figure 9:
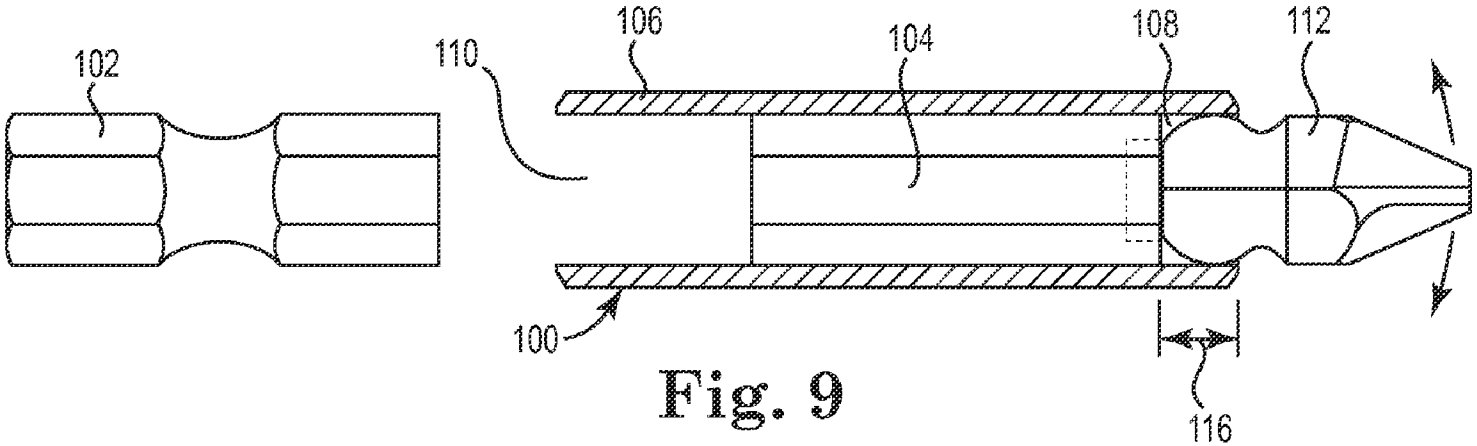
FIG. 9 is a side sectional view of an alternate bit holder and a bit in accordance with an embodiment of the present disclosure.

FIG. 9 is a side sectional view of bit holder 100 in accordance with another embodiment of the present disclosure. The intermediate shaft 104 is located within the outer sleeve 106 to create first socket 108 and second socket 110 at opposite ends of the bit holder 100. The intermediate shaft 104 is preferably secured to the outer sleeve 106, such as by a compression fit, pin, swaging, or the like.

The shank portion 102 and the interchangeable bit 112 can be coupled with either the first or second sockets 108, 110. The coupling of the shank portion 102, intermediate shaft 104 and outer sleeve 106, and interchangeable bit 112, can be magnetic, mechanical, frictional, and the like.

As illustrated in FIG. 9, first socket 108 has a depth 116 that permits interchangeable bit 112 to pivot off-angle, such as discussed in connection with FIG. 1. The first socket 108 corresponds to the unlocked configuration. Shank portion 102 couples with second socket 110 to act as an interface for a driver.

Figure 10:
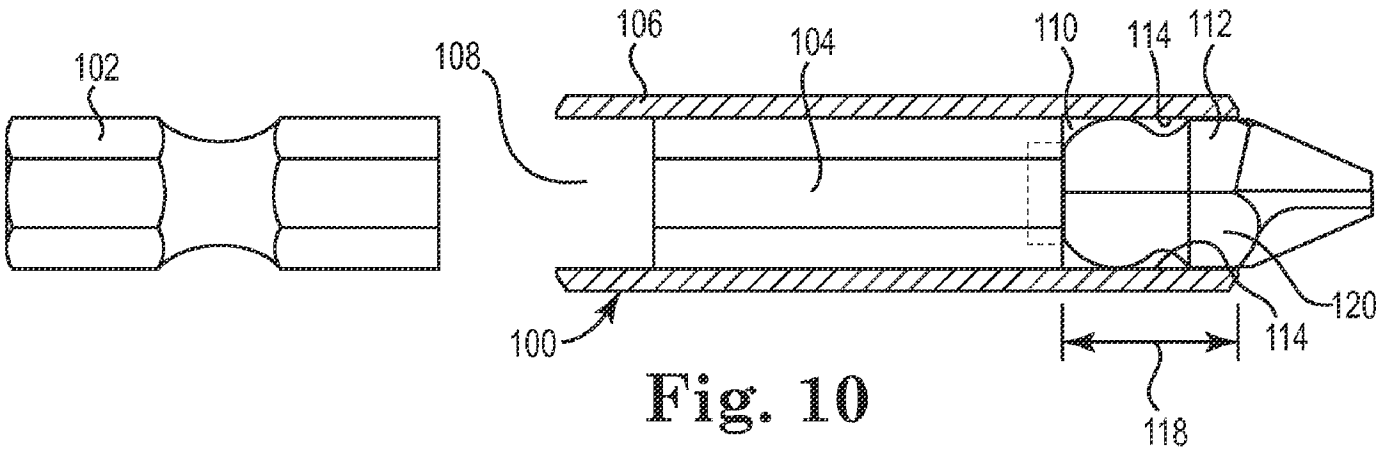
FIG. 10 is a side sectional view of the alternate bit holder and an interchangeable bit of FIG. 9 with the interchangeable bit in a locked configuration in accordance with an embodiment of the present disclosure.

As illustrated in FIG. 10, the intermediate shaft 104 and the outer sleeve 106 can be flipped over so the interchangeable bit 112 is located in the second socket 110, with a depth 118 greater than the depth 116. The second socket 110 corresponds to the locked configuration. Body portion 120 of the interchangeable bit 112 is constrained by the inner walls 114 of the outer sleeve 106 to act as a straight-on bit, such as illustrated in FIG. 7. Shank portion 102 is coupled with the first socket 108 to interface with a driver 100.

Where a range of values is provided, it is understood that each intervening value, to the tenth of the unit of the lower limit unless the context clearly dictates otherwise, between the upper and lower limit of that range and any other stated or intervening value in that stated range is encompassed within the disclosures. The upper and lower limits of these smaller ranges which may independently be included in the smaller ranges is also encompassed within the disclosures, subject to any specifically excluded limit in the stated range. Where the stated range includes one or both of the limits, ranges excluding either both of those included limits are also included in the disclosures.

Unless defined otherwise, all technical and scientific terms used herein have the same meaning as commonly understood by one of ordinary skill in the art to which these disclosures belong. Although any methods and materials similar or equivalent to those described herein can also be used in the practice or testing of the present disclosures, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present disclosures are not entitled to antedate such publication by virtue of prior disclosure. Further, the dates of publication provided may be different from the actual publication dates which may need to be independently confirmed.

Other embodiments of the disclosure are possible. Although the description above contains much specificity, these should not be construed as limiting the scope of the disclosure, but as merely providing illustrations of some of the presently preferred embodiments of this disclosure. It is also contemplated that various combinations or sub-combinations of the specific features and aspects of the embodiments may be made and still fall within the scope of the disclosures. It should be understood that various features and aspects of the disclosed embodiments can be combined with or substituted for one another in order to form varying modes of the disclosed disclosures. Thus, it is intended that the scope of at least some of the present disclosures herein disclosed should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims.

What is claimed is:

1. A bit holder comprising:

a shaft having a proximal end adapted to couple with a driver, and a distal end magnetically coupled to an interchangeable bit;

an outer sleeve surrounding the shaft in an unlocked configuration to form a socket with a non-circular cross section near the distal end of the shaft;

at least one interchangeable bit comprising a working end and a proximal portion with a non-circular cross section complementary to the socket, the proximal portion including a plurality of contoured portions that permit the interchangeable bit to articulate in the socket, the interchangeable bit further including a relief located between the working end and the proximal portion configured to permit articulation of the interchangeable bit and to engage with distal end of the outer sleeve to limit articulation relative to the shaft; and a locked configuration for the outer sleeve such that the distal end of the outer sleeve engages with a body portion of the interchangeable bit to retain the interchangeable bit generally aligned with a longitudinal axis of the shaft.

2. The bit holder of claim 1 comprising a magnet located near the distal end of the shaft.

3. The bit holder of claim 1 comprising a locking mechanism adapted to retain the outer sleeve in either the unlocked configuration or the locked configuration.

4. The bit holder of claim 1 comprising:

a snap ring interposed between the outer sleeve and the shaft;

a first set of grooves on the shaft adapted to engage with the snap ring when the outer sleeve is in the unlocked configuration; and a second set of grooves on the shaft adapted to engage with the snap ring when the outer sleeve is in the locked configuration.

5. The bit holder of claim 1 comprising a flat portion on the proximal portion of the interchangeable bit and a corresponding flat portion on the distal end of the shaft that cooperate to retain the interchangeable bit generally aligned with a longitudinal axis of the shaft when the outer sleeve is in the unlocked configuration.

6. The bit holder of claim 1 wherein the contoured portions of the interchangeable bit comprise a plurality of facets.

7. The bit holder of claim 1 wherein the proximal portion of the interchangeable bit comprises a hexagonal cross section and the socket comprises a plurality of surfaces arranged in a complementary hexagonal configuration, the interchangeable bit articulating primarily in a plane perpendicular to one of the plurality of surfaces.

8. The bit holder of claim 1 wherein a depth of the relief in the interchangeable bit determines a maximum angle of articulation relative to the longitudinal axis.

9. The bit holder of claim 1 wherein a location of the outer sleeve along the shaft determines a maximum angle of articulation relative to the longitudinal axis.

10. The bit holder of claim 1 wherein the outer sleeve comprises a plurality of unlocked configurations.

11. The bit holder of claim 10 wherein each of the plurality of unlocked configurations correspond to a different maximum angle of articulation.

12. The bit holder of claim 1 wherein a maximum angle of articulation for the interchangeable bit is about 5 degrees to about 25 degrees.

13. The bit holder of claim 1 wherein a minimum angle of articulation for the interchangeable bit is at least about 5 degrees.

14. The bit holder of claim 1 wherein a pivot location extends through the interchangeable bit perpendicular to the longitudinal axis.

15. The bit holder of claim 1 wherein a pivot location of the interchangeable bit relative to the socket is less than about 1.0 inches from a distal-most portion of the working end.

16. The bit holder of claim 1 wherein a pivot location of the interchangeable bit relative to the socket is less than about 0.4 inches from a distal-most portion of the working end.

17. A bit holder comprising:

an outer sleeve secured to a shaft to form a first socket with a first depth, and a second socket with a second depth greater than the first depth, at opposite ends of the outer sleeve, the first and second sockets each include a non-circular cross section;

a shank having a non-circular cross section complementary to the first and second sockets; and at least one interchangeable bit comprising a working end and a proximal portion with a non-circular cross section complementary to the first and second sockets, the proximal portion including a plurality of contoured portions that permit the interchangeable bit to articulate in the first socket, the interchangeable bit further including a relief located between the working end and the proximal portion configured to engage with distal end of the outer sleeve to limit articulation relative to the intermediate shaft, the outer sleeve at the second socket engaging a body portion of the interchangeable bit to retain the interchangeable bit generally aligned with a longitudinal axis of the shaft.

* * * * *